United States Patent [19]

von der Eltz

[11] 4,184,842

[45] * Jan. 22, 1980

[54] CONTINUOUS DYEING OF CELLULOSE FIBERS WITH REACTIVE DYESTUFFS

[75] Inventor: Hans-Ulrich von der Eltz, Frankfurt am Main, Fed. Rep. of Germany

[73] Assignee: Hoechst Aktiengesellschaft, Frankfurt am Main, Fed. Rep. of Germany

[ * ] Notice: The portion of the term of this patent subsequent to Oct. 22, 1991, has been disclaimed.

[21] Appl. No.: 703,686

[22] Filed: Jul. 8, 1976

Related U.S. Application Data

[63] Continuation-in-part of Ser. No. 547,779, Feb. 7, 1975, abandoned.

[30] Foreign Application Priority Data

Feb. 9, 1974 [DE] Fed. Rep. of Germany ..... 2406257

[51] Int. Cl.[2] ..... D06P 1/38; D06P 1/382; D06P 3/66; D06P 1/673

[52] U.S. Cl. ..... 8/1 A; 8/21 C; 8/1 E; 8/1 P; 8/1 XA; 8/82

[58] Field of Search ..... 8/1 A, 82, 163

[56] References Cited

U.S. PATENT DOCUMENTS

| | | | |
|---|---|---|---|
| 3,416,878 | 12/1968 | Biber | 8/82 |
| 3,418,308 | 12/1968 | Ischer et al. | 8/55 |
| 3,843,318 | 10/1974 | von der Eltz | 8/82 |

OTHER PUBLICATIONS

Textile World, Aug. 1964 pp. 83–88.

Fairchild's Dictionary of Textiles Fairchild Publ. Inc. N.Y. 1967 pp.141–142.

*Primary Examiner*—Donald E. Czaja

*Assistant Examiner*—Maria S. Tungol

*Attorney, Agent, or Firm*—Curtis, Morris & Safford

[57] ABSTRACT

Process for the continuous dyeing of flat textile structures made of cellulose fibers and their mixtures with synthetic fiber materials by applying onto the web of fibrous material an aqueous solution of at least one reactive dyestuff and a fixation agent mixture of a liquid alkali metal silicate of the formula $Me_2^I \cdot x\ SiO_2$ (x=3–5) (water glass) and an aqueous alkali metal hydroxide solution, placing the material thus treated into a dwelling chamber, exposing the material in a cuttled-up or opened-out condition in said chamber to humid heat, so that the dyestuff is fixed by the dwelling operation, and finally removing the material again continuously from the dwelling chamber.

5 Claims, 5 Drawing Figures

CONTINUOUS DYEING OF CELLULOSE FIBERS WITH REACTIVE DYESTUFFS

This application is a continuation-in-part of U.S. patent application Ser. No. 547,779, filed Feb. 7, 1975, now abandoned.

The present invention relates to a process for the continuous dyeing of cellulose fibers with reactive dyestuffs.

The advantages of the pad short-dwell process for the dyeing of cellulose fibers with reactive dyestuffs have been acknowledge all over the world. However, the discontinuous and/or semi-continuous operation of this dyeing process has always been thought of as a drawback: as has been well-known, this most important process up to the present time for the fixation of reactive dyestuffs is performed by way of padding the dyestuff solutions containing an alkaline agent onto the material and by allowing the material thus treated to dwell at room temperature for at least 90 minutes, normally for 2 to 4 hours, or even over night.

It has now been found that flat textile structures made of cellulose fibers or their mixtures with synthetic fiber materials can be dyed with reactive dyestuffs in a continuous operation according to the dwelling process, by applying an aqueous solution of at least one reactive dyestuff, together with a fixation agent mixture of a liquid alkali metal silicate of the formula $Me_2^IO.xSiO_2$(x=3-5) (water glass) and of from 37° to 60° Bé, preferably 49° Bé, and an aqueous alkali metal hydroxide solution of from 30° to 45° Bé, preferably 38° Bé in a weight ratio of from 1:0.1 to 1:0.5, onto the web of fibrous material, placing the material thus treated into a material tank, (dwelling chamber), exposing the material in a cuttled-up or opened-out condition in the tank to humid heat, at a temperature of from 20° to 80° C., preferably from 30° to 50° C., for 5 to 30 minutes, preferably 10 to 20 minutes, so that the dyestuff is fixed by the dwelling operation, and finally removing the material again continuously from the material tank.

Alkali metal silicates of the aforesaid type are well known under the definition "water glass" which term is accepted from such standard treatises as Kirk-Othmer, Encyclopedia of Chemical Technology, vol. 12, pp. 303-327 ("Soluble Silicates"), The Interscience Encyclopedia Inc., New York (1954) and from The Handbook of Chemistry and Physics, 54th Edition 1973/74 page B 140, No. S. 402.

According to the above-mentioned processes, dyeing results are obtained which show a full color yield even at a dwelling time that has been considerably reduced. This result is only possible if a mixture of alkali metal silicate (water glass) and alkali metal hydroxide (optionally with the addition of soda) is used as fixation agent for the reactive dyestuffs applied, instead of the alkali metal hydroxide used so far. The concentrations of the alkaline substances required in order to obtain a satisfactory fixation rate still permit a reliable operation due to the high water glass content.

The application of the dye bath is effected by means of a known padding unit, by way of a spraying or foaming process. In order to increase the fixation rate, the textile material is padded, according to the invention, at a temperature in the range of from 20° to 80° C., preferably from 30° to 60° C. This can be achieved by introducing the dye liquors into the padder in a pre-heated condition, or by applying them to the goods in a trough that may be heated, or by making the fibrous material pass the dye application device already in a pre-heated state. The impregnation itself may also be effected within the preheated dwelling chamber.

After the dyestuff has been applied, the web of textile material is preferably placed on a sieve belt, while being cuttled-up in a slanting position (material tank), and is allowed to dwell. This endless sieve belt may be arranged horizontally or may be inclined. It is also possible to use a single long belt or several belts which have been arranged one above the other. This belt or these subdivided belts have been placed into a closed unit, the total capacity of which is in the range of from 200 to 1000 m, preferably from about 400 to 800 m of textile web. In this unit an operation resulting in material rates of from 10 to 80 meters per minute is possible.

The temperature in the material tank, in which the material is heated to a temperature of up to 80° C.—as has been mentioned already—is controlled by means of infra-red radiators, since this process does not require too much energy, and also by steam injection at the same time. This method ensures a constant moisture on the material which is maintained at an exact level. A suction treatment of the material by means of humid hot air can also be effected. The sieve belt unit is very suitable for all suction and injection processes, as the material is present on the sieve belt either in an upset or plaited down form, or is lying completely flat. It is also possible to make steam pass through the material on the sieve belt where it is lying in opened-out condition.

At a temperature in the material tank of from generally 20° to 80° C., there is no risk that spots may be formed through the development of condensation water, since a very exact temperature and humidity control within this range is possible.

The development of this process has helped to reach a technical goal that has been aimed at for a long time. It was surprising and could not have been foreseen that the difficulties in the fixation of reactive dyestuffs in the dwelling process can be overcome by means of the mixture of the alkaline substances. In spite of the $CO_2$ content of the air in the dwelling chamber, the alkali metal silicate (water glass) in this process prevents the alkalinity from being constantly reduced during the fixation process, which would then result in an insufficient fixation of the dyestuffs. Besides, temperature deviations towards a higher range cannot adversely affect the dyeing result. Also, the moisture content within the unit prevents the dyeing from drying out. The slightly elevated temperature—in combination with the mixture of the alkaline substances—results in a suitable fixation time. Moreover, this required temperature range is very easy to control. There is no need to use an extremely large amount of alkali metal hydroxide.

With regard to the feasibility of the claimed process in practice, it was also not to be expected that there is no unevenness of the dyeings which would normally appear through the piling up of the moist material.

As compared against the wet-steaming process known hitherto, the new process results in a considerably lower tendency towards hydrolysis of the reactive dyestuffs, due to the mixture of the alkaline substances used according to the invention. This leads to an increased color yield, in particular with deep shades.

For the process of the invention, use may also be made of dyestuff combinations which have a lower fixation rate. In these cases, the dyestuff fixation can be completed by a steaming process, for example at 103° C., following the dwelling process, or by dipping the material coming from the dwelling process into a hot solution of the alkali metal silicate (water glass). Here again, it is the mixture of alkali metal hydroxide solution and water glass which prevents any expected difficulty from appearing. There is no need to exactly maintain the temperature of these after-treatment processes; also, the steamer is not required to be absolutely free from air, and a possible exceeding of the steaming time does not involve any drawbacks. A final passage of the fibrous material through a hot solution of alkali metal silicate and alkali metal hydroxide solution may also force an immediate fixation. The advantage of the process according to the invention is to be seen in the fact that the color-yield is markedly higher for the described combination of dwelling phase and hot after-fixation than for the operation omitting the described dwelling process, which may be explained by both the rinsing effect and the higher hydrolysis reaction.

The new process can be used for woven goods made of cellulose fibers and their mixtures with synthetic fibers, as well as for knitted fabrics and particularly for tubular knitted goods, terry cloth goods and all velour and velvet materials.

The so-called dwelling-fixation process can also be used successfully for the dyeing of mixed fabrics made from polyester/cellulose fibers. In this case, the polyester fiber portion is at first dyed with disperse dyestuffs according to the Thermosol process, and subsequently the cellulose fiber component is dyed in accordance with the process of the invention. However, it is also possible to dye the cellulose fiber first, if reactive dyestuffs are used that are resistant to hydrolysis. During the time in the material tank, during the washing process and also during the subsequent thermo-fixation there may be a promotion of the bulkiness of the goods each time, for suitable fiber material. It is also possible to dye the polyester fiber subsequently in a jet dyeing device.

As reactive dyestuffs there may be mentioned, for the present process, the organic dyestuffs known by this term. These are predominantly those dyestuffs which contain at least one group reactive with polyhydroxyl fibers, a precursor to this group, or a substituent reactive with the polyhydroxyl fiber. As basic structures of the organic dyestuffs that may be used in particular those of the series of the azo, anthraquinone and phthalocyanine dyestuffs are suitable, the azo and phthalocyanine dyestuffs optionally being free from metal or containing metal. As reactive groups and precursors forming these reactive groups in an alkaline medium there may be mentioned, for example, epoxy groups, the ethylene imide group, the vinyl group in a vinyl sulfone group or in an acrylic acid radical, besides, the β-sulfato-ethyl sulfone group or the β-chloroethyl sulfone group. For these processes, use may also be made of derivatives of the tetrafluoro-cyclobutyl series, for example, that of the tetrafluoro-cyclobutyl-acrylic acid. As reactive substituents in reactive dyestuffs, there may be used those substances which can be split off easily and which leave an electrophilic radical. As examples for substituents of this kind there may be mentioned halogen atoms in the following ring systems: Quinoxaline, triazine, pyrimidine, phthalazine, and pyridazone. Use may also be made of dyestuffs having several reactive groups of a different kind.

The alkali metal hydroxide solutions necessary for the fixation can be used in the amount usually applied for the dyeing with reactive dyestuffs, in most cases from about 5 to 150 grams per liter of padding liquor. As alkaline compounds of this type, there may be mentioned advantageously aqueous solutions of preferably sodium hydroxide, also of potassium hydroxide, corresponding to an alkalinity of between 30° and 45° Bé.

Of the liquid alkali metal silicates (water glasses) to be added to the padding baths according to the invention process, there may be mentioned advantageously commercial sodium silicates of the formula $Na_2O.xSiO_2$(x=3–5). Preference is given to sodium silicates of an alkaline strength of from about 37° to about 60° Bé, corresponding to a $SiO_2$ content of the aqueous solution of from about 27.2 to about 38.2% by weight. The amount to be used depends on the alkaline strength of the alkali metal silicate used, on the dyestuff concentration, and on the type of dyestuff, and is generally in the range of from about 25 g to about 350 g, preferably about 50 g to 200 g, per liter of padding liquor.

BRIEF DESCRIPTION OF THE DRAWINGS

FIG. 1 is a schematic diagram showing one advantageous arrangement of the apparatus for carrying out the invention.

FIGS. 2 and 3 show a modification of the apparatus shown in FIG. 1.

FIGS. 4 and 5 show further modifications in which the path of travel of the web is extended over a plurality of conveyor belts.

Figure 1:
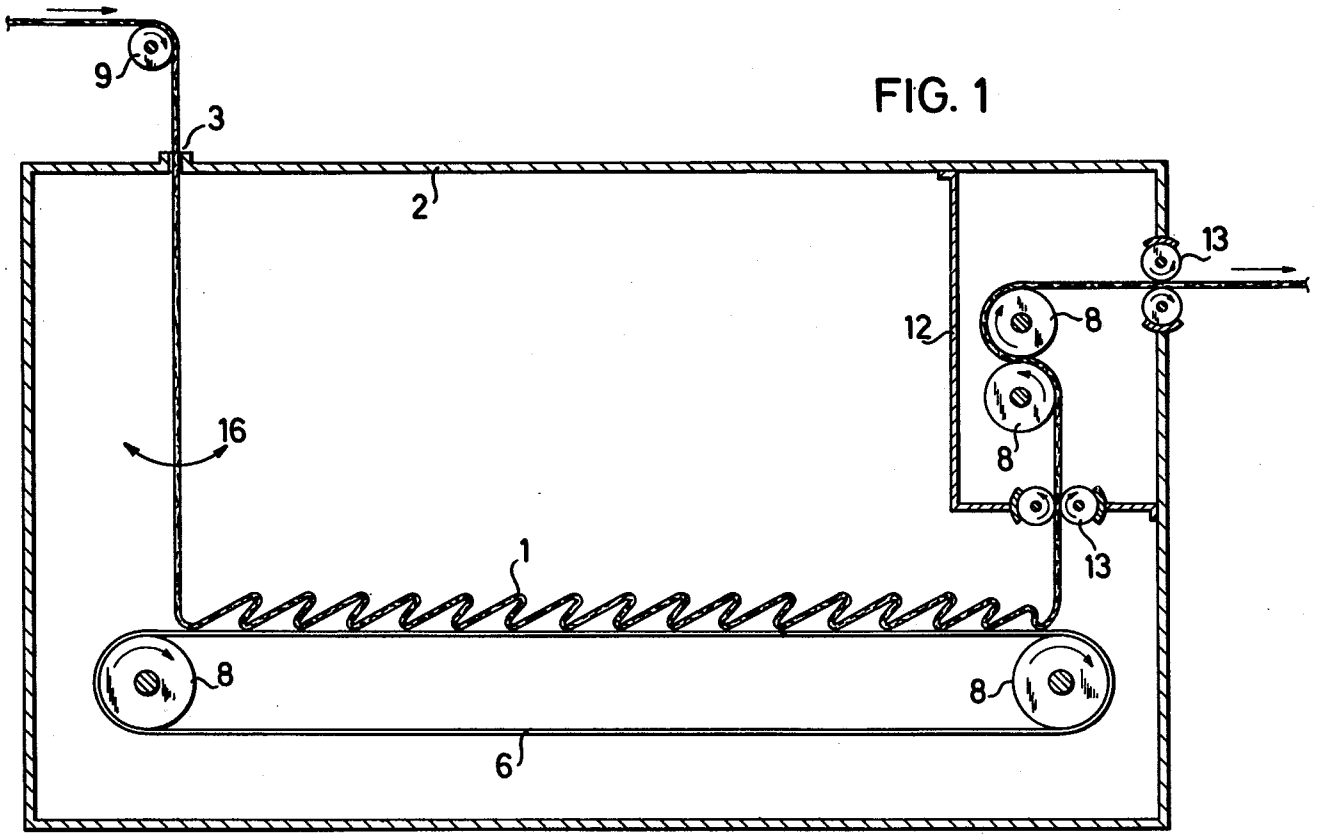
FIGS. 1–5 are schematic diagrams of alternative advantageous arrangements of apparatus for carrying out the invention. The reference numerals on FIGS. 1–5 have the meanings stated below.
Figure 2:
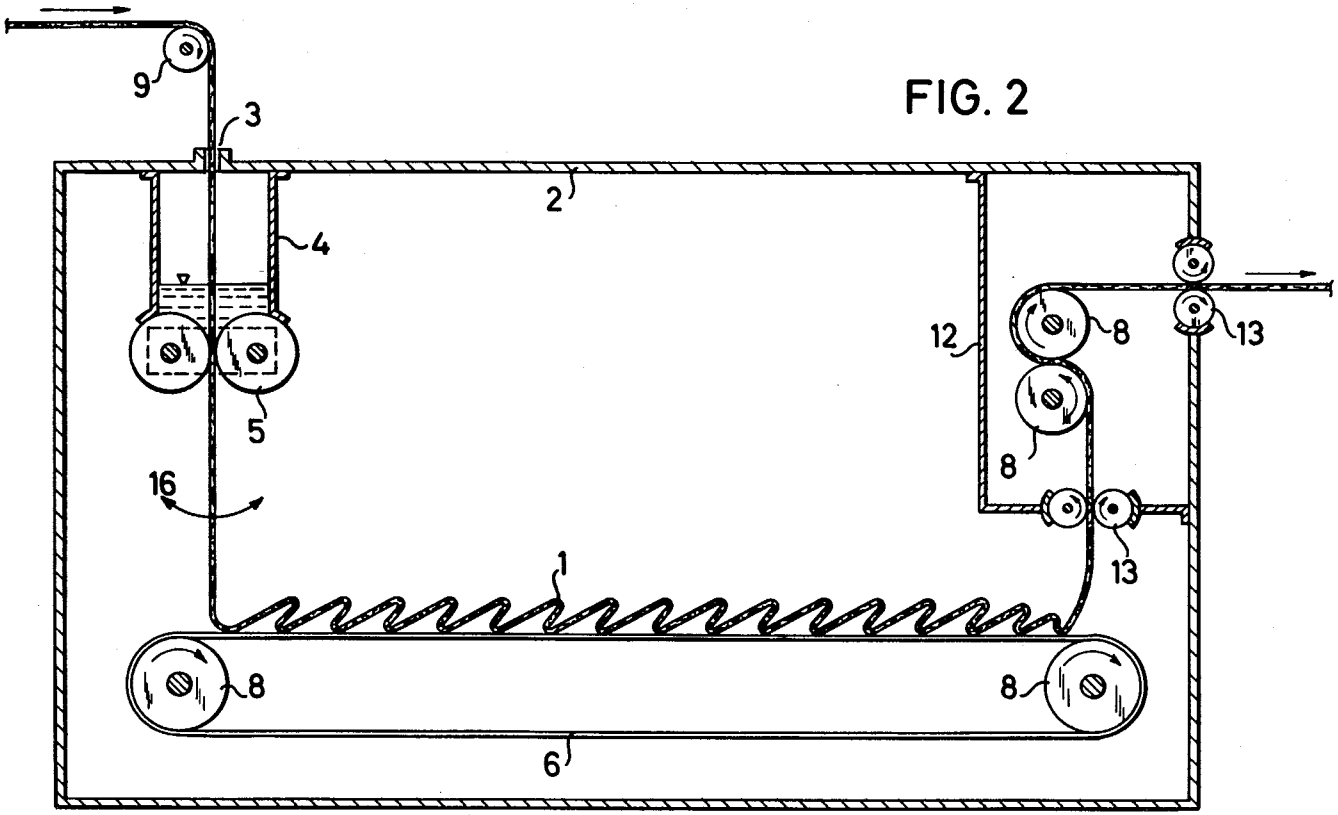
Figure 3:
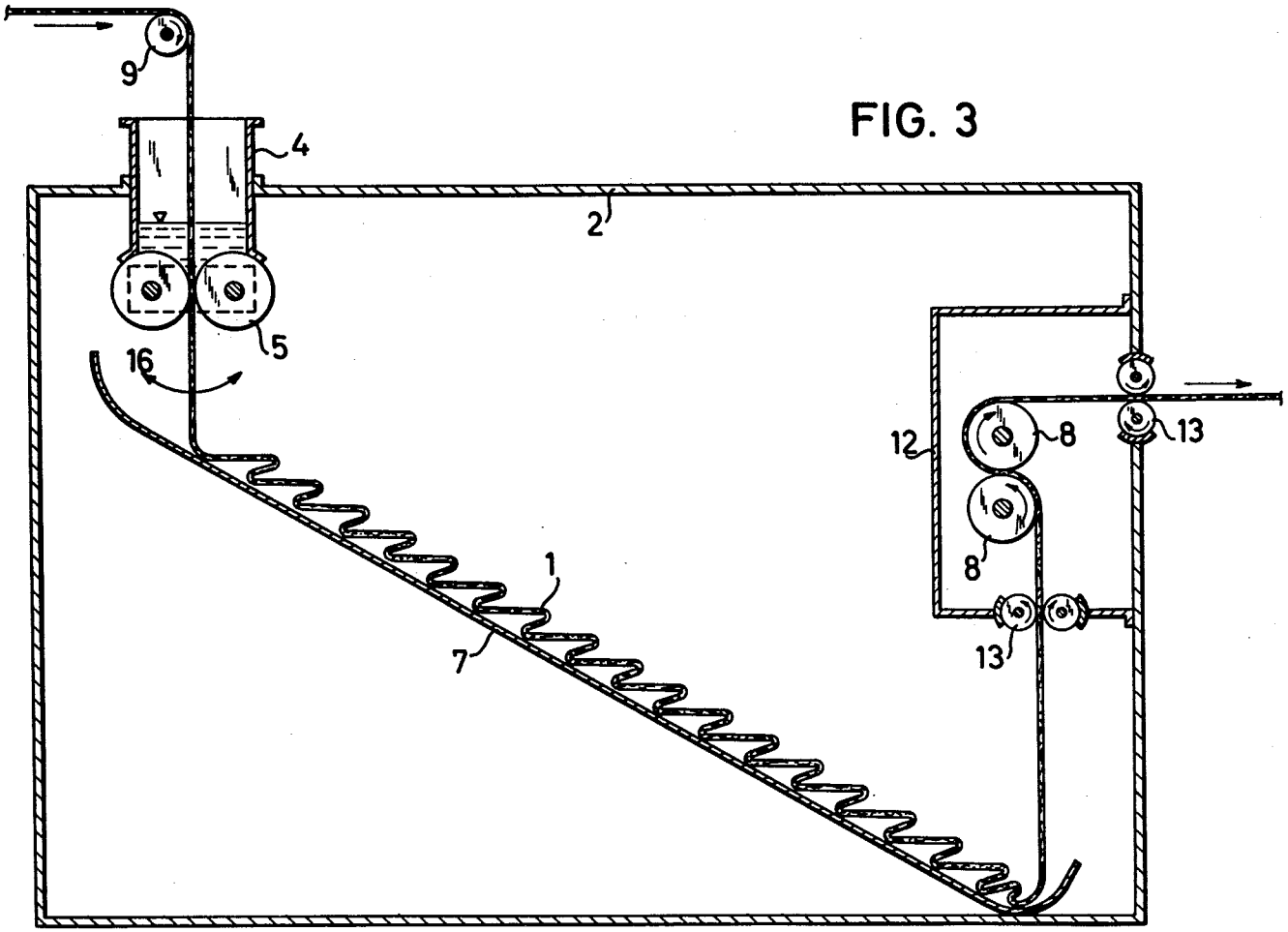
Figure 4:
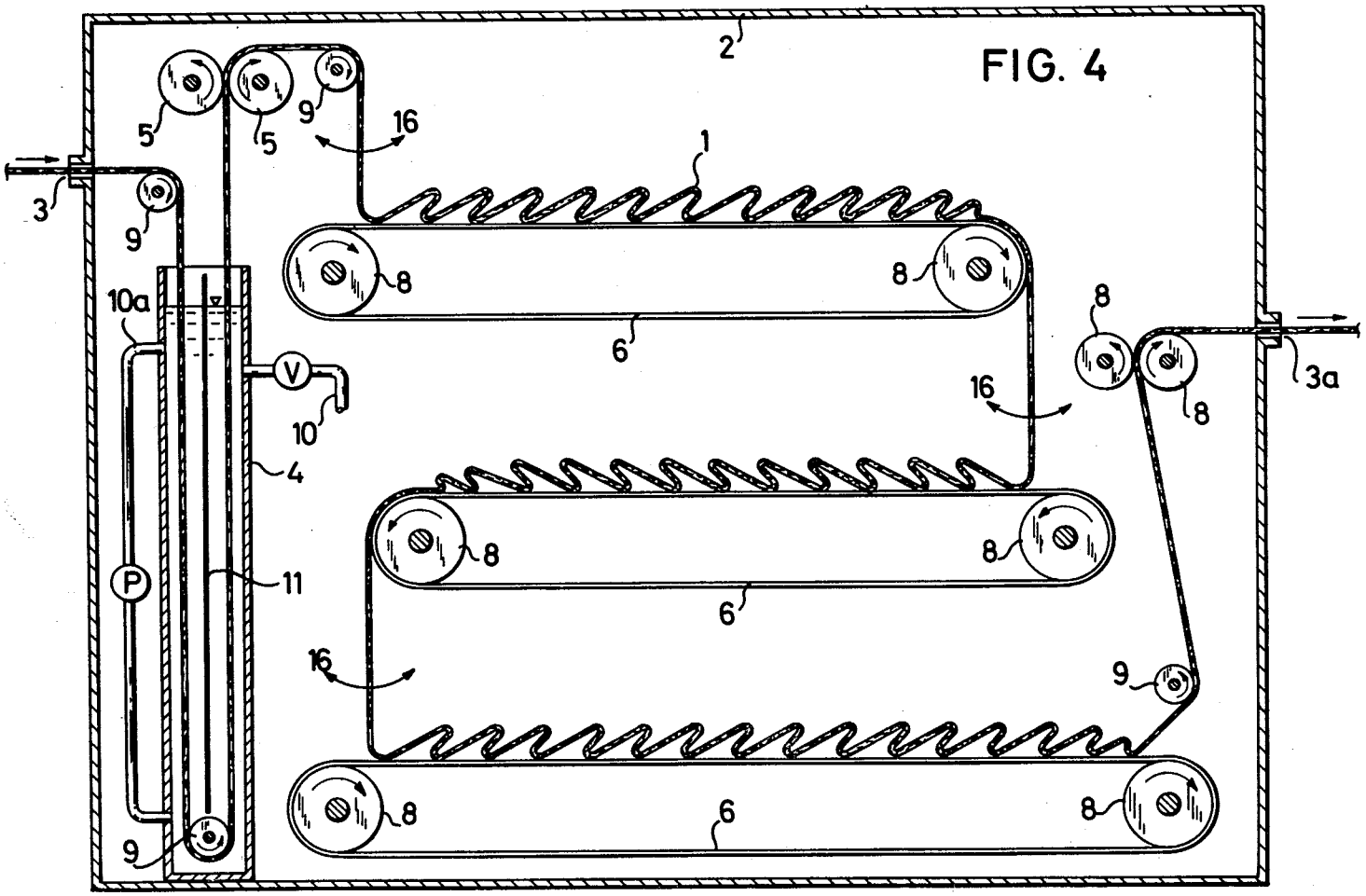
Figure 5:
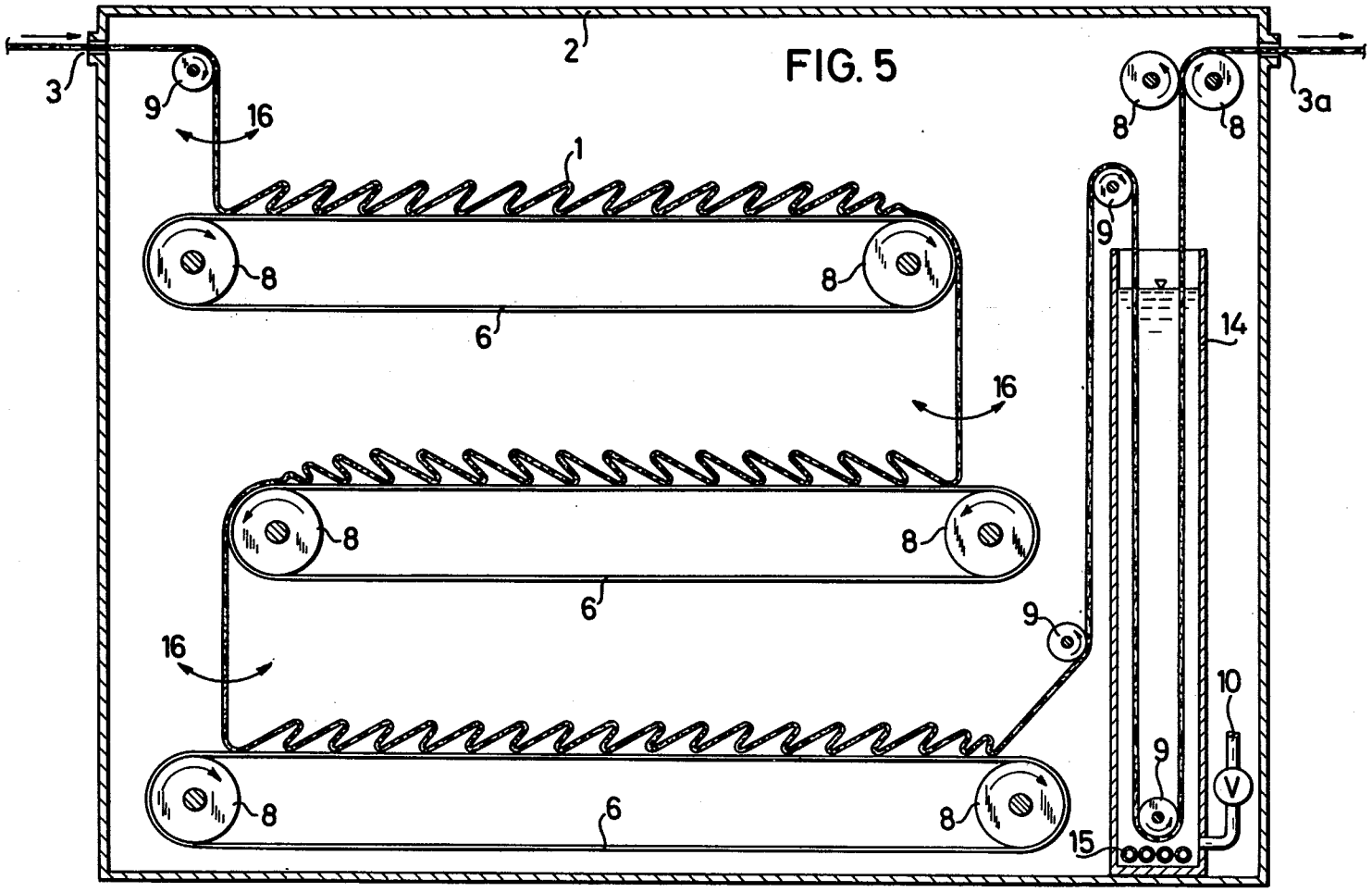

1 web of material
2 treatment (dwelling) chamber with temperature and humidity control
3 inlet slits
**3*a*** outlet slits
4 through for the liquor
5 pair of rollers of the padder, squeezing apparatus, optionally with open-width stacking device
6 endless conveyor belts
7 inclined material tank, may also be in the form of a trough, boot, etc.
8 driven transport rollers
9 guide rollers
10 liquor intake
**10*a*** distributor for the liquor to intensify the circulation in the trough with a pump main
11 partition wall in the padding trough; the liquor may be fed according to the counter-current principle at the zone where the goods leave the trough
12 steaming compartment
13 pair of rollers as a sealing device for slight differences in pressure as inlet and outlet for the steaming compartment
14 dipping trough for the short passage through the hot alkali metal silicate solution, to be heated, with liquor intake
15 heating elements
16 slewing direction of the plaiting-down device (not shown) here).

The following Examples serve to illustrate the invention. The statements concerning sodium silicate mean a liquid sodium silicate of the formula $Na_2O.x\ SiO_2$(x-

=3–5). Because the specific gravity of sodium hydroxide solution is approximately 1.0, therefore the volumes of sodium hydroxide solution used correspond to the respective amounts in grams.

EXAMPLE 1

A fabric made of spun rayon staple fibers was padded by means of an aqueous dye liquor containing, per liter of liquor, 50 g of the dyestuff of the formula

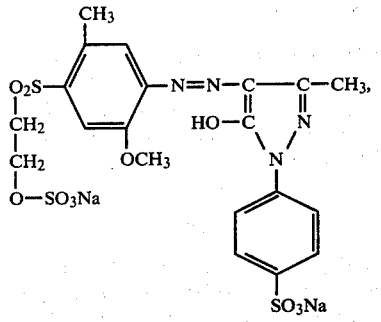

and besides, 100 g/l of sodium silicate of 49° Bé and 20 cc./l of sodium hydroxide solution of 38° Bé (32.5% by weight), at a temperature of 35° C. and with a dye liquor pick-up of 70% (calculated on the weight of the dry goods), and was subsequently allowed to dwell in a plaited down state at 40° C. After a dwelling time of 10 minutes and the usual after-treatment of the dyeing, practically the same yield of fixed dyestuff was obtained, as if this padding had been effected at room temperature (21° C.) and the dwelling time, according to the known cold-dwelling method, had been 2 hours (also at room temperature).

The comparison of the tinctorial strength of the two dyeings, determined according to the colorimetric values, was 97:100.

EXAMPLE 2

A fabric made of mercerized cotton was padded by means of an aqueous dye liquor containing the same dyestuff as in Example 1, in the same concentration, and in the presence of 100 g/l of sodium silicate of 49° Bé and 30 cc./l of sodium hydroxide solution of 38° Bé, at a temperature of 18° C. and with a dye liquor pick-up of 70% by weight, and was allowed to dwell for 5 minutes at the same temperature. Subsequently, the padded goods were treated during 10 seconds with a sodium silicate solution at 95° C.

After the usual after-treatment of the dyeing, a ratio of the color yield of 97:100 was obtained, as compared against a dyeing having the usual color yield according to the proven pad short-dwell process, with a dwelling time of 2 hours at room temperature.

If the dyeing prepared as has been mentioned above was subsequently steamed for 10 seconds at a temperature of from 103° to 105° C., after a dwelling time of 5 minutes at room temperature, the resulting dyeing was of the same intensity (97:100). However, if in the present case the dwelling phase was omitted and the fabric was steamed immediately after the padding process, at a temperature of from 103° to 105° C., dyeings were obtained which showed a markedly reduced tinctorial strength. The tinctorial strength was then after a steaming time of 10 seconds 76:100

30 seconds 84:100

60 seconds 84:100.

These measurements were performed by means of a Hardy spectrophotometer.

EXAMPLE 3

30 g/l of the dyestuff of the formula

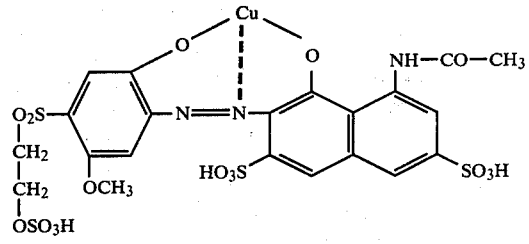

were padded, together with 100 g/l of sodium silicate of 49° Bé and 20 cc./l of sodium hydroxide solution of 38° Bé, in the form of an aqueous dye liquor, on several spun rayon fabrics, at a temperature of 40° C. and with a dye liquor pick-up of 70% by weight, and were allowed to dwell at the same temperature for 10 or 20 minutes. The yield obtained following the after-treatment of these dyeings corresponded to the color yield which can be obtained according to the known pad short-dwell process. Even an extension of the dwelling time of the dyeing at 40° C. to 40 minutes did not alter the color with respect to its shade and depth.

EXAMPLE 4

A mercerized cotton fabric was impregnated with an aqueous dye liquor containing 20 g/l of the dyestuff of the formula

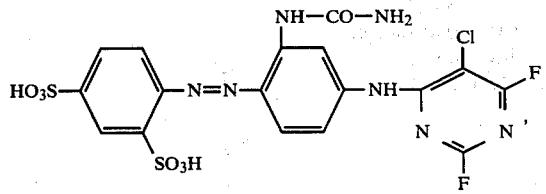

100 g/l of sodium silicate of 49° Be and 30 cc. of sodium hydroxide solution of 38° Be, at a temperature of 23° C., and was allowed to dwell, in a plaited-down state, for 5 minutes at this temperature. In an analogous manner, a second padding was treated, after a dwelling time of 5 minutes, during 10 seconds with saturated steam at a temperature of 105° C. The color yields obtained of the two dyeings after the subsequent treatment (thorough rinsing and removing of the unfixed dyestuff proportion) were compared with each other, and the same depth of shade was found to be there.

EXAMPLE 5

An aqueous dye liquor containing 50 g/l of the dyestuff of the formula

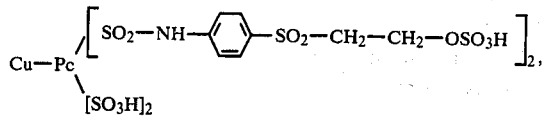

(Cu—Pc—,= copper phthalocyanine)

100 g/l of sodium silicate of 49° Bé and 30 cc./l of sodium hydroxide solution of 38° Bé, was padded on a mercerized cotton fabric at a temperature of 22° C. and with a dye liquor pick-up of 70% by weight. Following a dwelling time of the padding of 10 minutes, the goods were steamed for 10 seconds at a temperature of from 103° to 105° C. After the usual subsequent treatment, a color yield of the dyeing thus produced was obtained which had a ratio of 97:100, as compared against a dyeing that had been allowed to dwell over night at room temperature, according to the pad dwell process.

When the padding prepared according to the above-mentioned method was allowed to dwell for 10 minutes at room temperature and was subsequently dipped for 10 seconds into a solution of sodium silicate of 95° C., a dyeing was obtained which had the same depth of shade. By extending the dwelling time at room temperature to 20 minutes, the color yield of this dyeing could even be increased by 5%.

However, if the goods were padded with the same dyestuff and the chemical substances mentioned above, and if this padding was steamed immediately, without dwelling time, i.e. according to the wet-steaming process, dyeings showing a markedly reduced tinctorial strength would be obtained, even after a steaming time of 30 seconds.

The tinctorial strength after 10 seconds of steaming was 44:100, and after 30 seconds of steaming, 76:100.

EXAMPLE 6

Instead of the dyestuff mentioned in Example 5, an aqueous dye liquor containing 50 g/l of the dyestuff of the formula

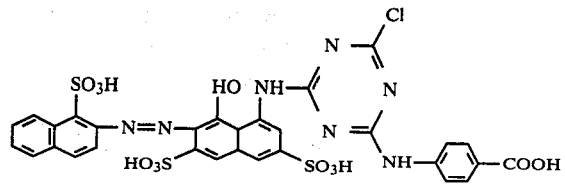

was used in this case, the other conditions being unchanged.

After the padding had been allowed to dwell for 10 minutes at room temperature, it was dipped for 10 seconds into a solution of sodium silicate of 95° C. The color yield that could be obtained with this dyeing was comparable to that obtained according to other dyeing methods.

EXAMPLE 7

When for the dyeing performed by way of the padding process according to Example 5 the same amount of the dyestuff of formula

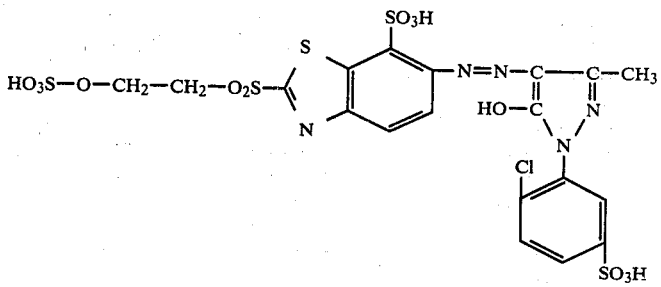

was used, and the goods were dyed according to the conditions mentioned in the said Example, a good color yield was obtained after a dwelling time of 20 minutes at room temperature and a subsequent treatment of the padding during 10 seconds in a sodium silicate solution at 95° C.

EXAMPLE 8

An aqueous dye liquor containing 30 g per liter of the dyestuff of the formula

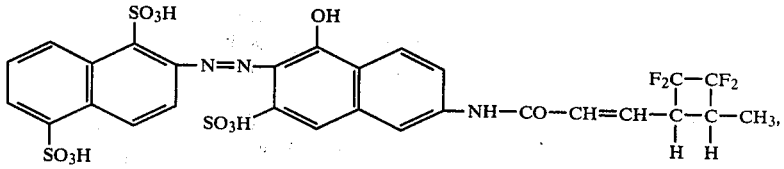

as well as 100 g of sodium silicate of 48° Bé and 30 cc. of sodium hydroxide solution (32.5%) was padded on a mercerized cotton fabric at a temperature of 40° C. and with a dye liquor pick-up of 70% by weight. After a dwelling time of 10 minutes at a temperature of 40° C., the goods were steamed for 30 seconds at a temperature of from 103° to 105° C. The depth of shade obtained after the subsequent treatment was compared with a dyeing that had been steamed at a temperature of from 103° to 105° C. for 30 seconds, without dwelling at 40° C. immediately after the padding. The ratio of the tinctorial strength was 100:86 in favor of the process including the dwelling phase.

EXAMPLE 9

A knit fabric made from bleached cotton was padded at room temperature, with a dye liquor pick-up of 70% by weight, by means of an aqueous dye liquor containing 50 g/l of the dyestuff of the formula

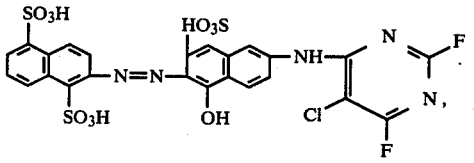

100 g/l of sodium silicate of 49° Bé and 40 cc./l of sodium hydroxide solution of 38° Bé. This padding was now allowed to dwell for 2 hours at room temperature. In another case, the padded goods were steamed for 10 seconds at a temperature of from 103° to 105° C., following a dwelling time of 5 minutes at a temperature of from 30° to 40° C.

After the usual after-treatment, the same depth of shade was obtained in each case.

EXAMPLE 10

50 g/l of the dyestuff of the formula

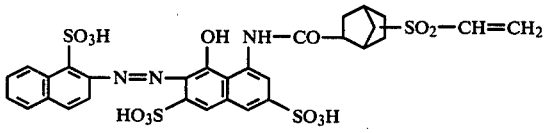

were padded in the form of an aqueous dye liquor, together with 100 g/l of sodium silicate of 49° Bé and 30 cc./l of sodium hydroxide solution of 38° Bé, at a temperature of 40° C., on a mercerized cotton fabric, and the padding was allowed to dwell for 10 minutes at a temperature of 40° C. Subsequently, the fabric was dipped for 10 seconds into a sodium silicate solution of 95° C. When, however, in the present case the padding and dwelling were performed at room temperature (21° C.), a tinctorial strength of 100:96 was obtained after the usual after-treatment. However, when the padded goods were dipped immediately into a hot sodium silicate solution for 10 and 30 seconds without dwelling time, the tinctorial strength was markedly reduced (68:100).

I claim:

1. A process for the continuous dyeing of flat textile structures made of cellulose fibers and their mixtures with synthetic fiber materials by means of reactive dyestuffs, which comprises applying, at a temperature of from 20° to 80° C., an aqueous solution of at least one reactive dyestuff, and a fixation agent mixture of a liquid sodium silicate of the formula $Na_2O.xSiO_2$(x—3–5) and of from 37° to 60° Bé and an aqueous sodium hydroxide solution of from 30° to 45° Bé in a weight ratio of from 1:0.1 to 1:0.5, onto the web of fibrous material, placing the material thus treated into a dwelling chamber, exposing the material in a cuttled-up or opened-out condition in said chamber to humid heat, at the above-mentioned temperature range for 5 to 30 minutes, so that the dyestuff is fixed by the dwelling operation, and finally removing the material again continuously from the dwelling chamber.

2. A process as claimed in claim 1, wherein the fixation of slowly reacting dyestuffs is completed by a steaming process of from 10 to 30 seconds following the dwelling phase.

3. A process as claimed in claim 1, wherein the fixation of slowly reacting dyestuffs is completed by a dipping of the goods into a sodium silicate solution (water glass) at a temperature of 95° C. for 10 seconds.

4. A process as in claim 1, wherein the padding liquors are preheated and introduced into the padder, or the dye liquor is applied onto the goods in a trough to be heated.

5. A process as claimed in claim 1, wherein the impregnation may also be effected within the pre-heated dwelling chamber.

* * * * *